United States Patent [19]

Redondo

[11] Patent Number: 4,919,053

[45] Date of Patent: Apr. 24, 1990

[54] CONVEYOR WITH TWIN BIAS ACCUMULATION

[75] Inventor: Miguel A. Redondo, Overland Park, Kans.

[73] Assignee: Mid-West Conveyor Company, Inc., Kansas City, Kans.

[21] Appl. No.: 388,602

[22] Filed: Aug. 1, 1989

[51] Int. Cl.[5] ..... E01B 25/22; B61B 3/00

[52] U.S. Cl. ..... 104/91; 104/88; 104/177.4

[58] Field of Search ..... 104/91, 92, 98, 101, 104/172.4, 88

[56] References Cited

U.S. PATENT DOCUMENTS 445,060 1/1891 Jarvis .
3,195,473 7/1965 Dehne ..... 104/91
4,372,218 2/1983 Ostlund .
4,602,566 7/1986 Kernkamp et al. ..... 104/91

FOREIGN PATENT DOCUMENTS 54-97918 1/1978 Japan ..... 104/88

*Primary Examiner*—Andres Kashnikow
*Assistant Examiner*—M. Cunningham
*Attorney, Agent, or Firm*—Litman, McMahon & Brown

[57] ABSTRACT

A conveyor system comprises a power and free central power track for receiving lead trolleys of a carrier and a pair of free tracks positioned on opposite sides of the power track for alternatively receiving trailing trolleys of the carriers such that the carriers are twin biased accumulated or banked in side-by-side relationship to one another on opposite sides of the power track. A switching mechanism is provided to control switching of the lead and trailing trolleys from a feed track to the appropriate power track or free track.

7 Claims, 4 Drawing Sheets

CONVEYOR WITH TWIN BIAS ACCUMULATION

BACKGROUND OF THE INVENTION

The present invention relates to conveyors and, in particular, to conveyors wherein carriers riding on trolleys of the conveyor are accumulated, staged or banked at a compact location within the conveyor system.

Power and free type conveyors are utilized in many installations for conveying partially assembled goods from one point of assembly to the next, for conveying finished goods from an assembly location to a storage location, for conveying finished goods from a warehouse to a distribution point and the like. For some installations, it is important to provide an accumulation area for the carriers at a desired location. For example, there may be a work station just downstream from the accumulation area where an assembler can only work on a single structure being carried by one of the carriers. Hence, it is necessary to restrain the remaining carriers until the assembler has completed work on the one in front of him, at which time he can send it downstream and divert a second carrier to the work station from the accumulation area.

If there are many carriers to be accumulated at the accumulation area and, especially, if the carriers are very long, (for example, where the carrier is transporting an automobile body), then the length of conveyor required to accumulate these carriers becomes quite long. A lengthy section of conveyor utilized just as a location for accumulation is both expensive and may consume a great deal of space. Therefore, conveyor manufacturers have attempted to overcome this problem by inserting bias or side-by-side tracks that are positioned next to or near the main conveyor.

An example of such a system is shown in the Dehne U.S. Pat. No. 3,195,473. Another such system is shown in the Kernkamp U.S. Pat. No. 4,602,566. Each of these patents partially resolves the problem of carriers accumulating in an end-to-end train-like fashion by allowing them to accumulate in a side-by-side configuration wherein the carriers are aligned generally perpendicular or at least at a substantial angle relative to the main track. Such systems allow accumulation of the carriers in a relatively small area.

Both of the above noted systems, especially the Dehne system, works well for certain types of carriers carrying certain types of loads. However, the Dehne system does not work where the load on the carrier is wider than the trolleys associated with the carrier, since adjacent loads would unacceptably collide with each other before the trolleys of adjacent carriers were able to engage one another and effectively space the loads. To overcome this problem, it is possible to extend the length of the trolley to a length greater than the width of the load; however, this then takes away from valuable space along the length of the main conveyor line.

It also continues to be desirable in the conveyor industry to try to develop methods of further compressing the accumulation area and thereby reduce costly building space or to allow some of the space previously used for a conveyor to be used for manufacturing functions.

OBJECTS OF THE INVENTION

Therefore, the objects of the present invention are: to provide a conveyor system including an accumulation region; to provide such a system wherein the accumulation region includes twin bias banking wherein the system includes a power track with parallel free tracks on either side thereof; to provide such a system including switch and control mechanisms to automatically divert or feed leading trolleys of paired trolley carriers to the power track and the trailing trolleys of the paired trolley carriers alternatively to one or the other of the free tracks so as to stack loads of the carriers in side-by-side fashion on each side of the power track while the lead trolleys associated with the load carriers of each side of the power and free track are alternated so as to not interfere with one another; to provide such a system including pusher means for urging the trailing trolleys of the carriers onto the free track; to provide such a system that is relatively compact and easily integrated into a general conveyor system, especially of the power and free type; to provide such a system which is relatively inexpensive to build, easy to maintain and especially suited for the intended purpose thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
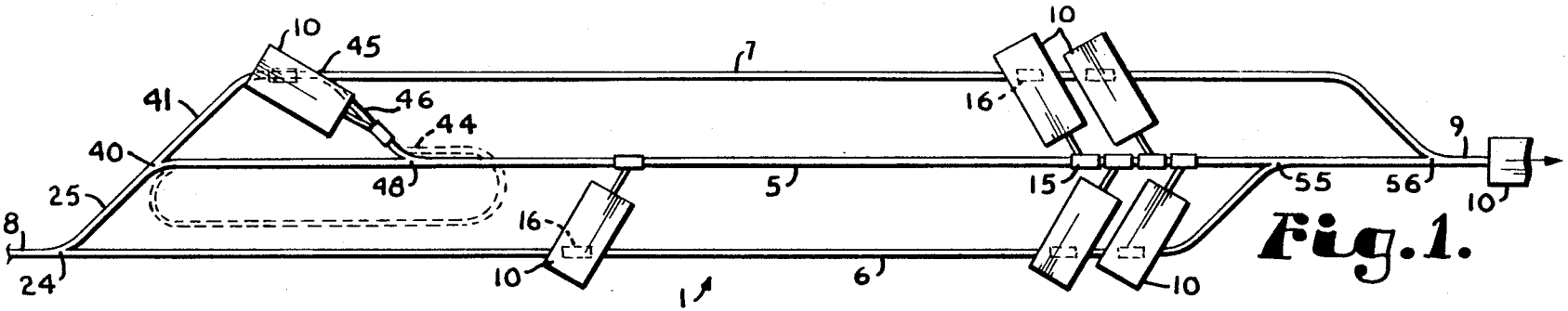
FIG. 1 is a top plan view of a twin bias banking or accumulation region of a conveyor system in accordance with the present invention.

The reference numeral 1 generally represents a power and free conveyor system incorporating twin bias banking in accordance with the present invention. The conveyor system is best seen in FIG. 1. The conveyor system 1 includes a central power track 5, a first free track 6, a second free track 7, a feed track 8, a discharge track 9 and a plurality of carriers 10. Each carrier 10 includes a lead trolley 15 and a trailing trolley 16.

The supply track 8 includes a pair of C-shaped channels 17 in facing relationship with one another and supporting opposed wheels 18 of trolleys such as trolleys 15 and 16 passing therethrough. Beneath the C-shaped channels is a driving chain 19 which rides upon a separate track 20 to form a power and free conveyor system. The power and free conveyor systems are quite common and an inverted power and free conveyor system such as described herein is illustrated in U.S. Pat. No. 4,790,247 of Summa et al. which is incorporated herein by reference. The lead trolleys 15 of carriers 10 that are on the feed track 8 are driven therealong by dogs 21 attached to the driving chain 19.

Figure 4:
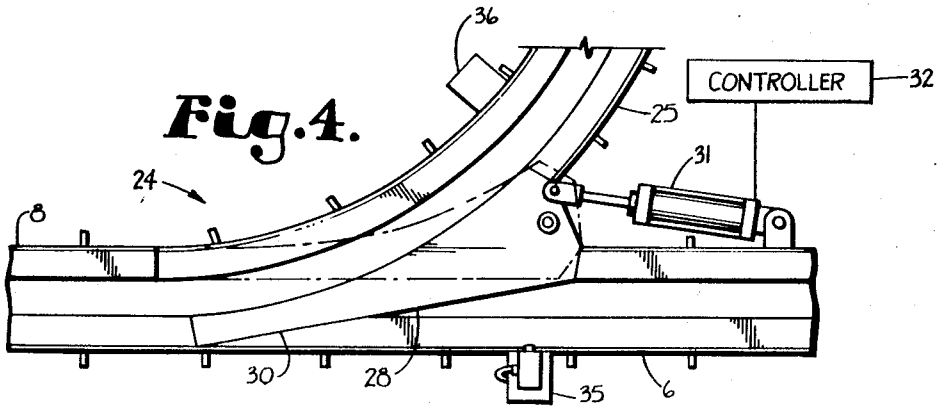
FIG. 4 is an enlarged, fragmentary and top plan view of the conveyor system, showing detail of a switch.
Figure 3:
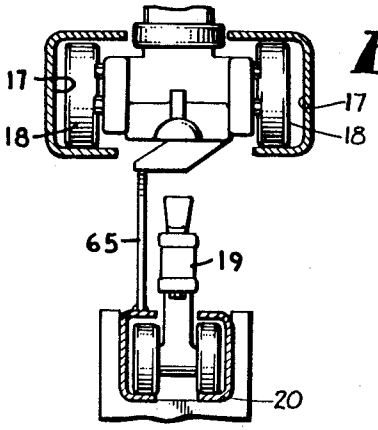
FIG. 3 is an enlarged, fragmentary and cross-sectional view of the conveyor system, taken along line 3—3 of FIG. 2.

The feed track 8 intersects the first free track 6 at a forked junction 24. The junction 24 is illustrated in FIG. 4 along with a diverging track 25 which also intersects with the feed track 8 at the juncture 24. A switch 28 controls transfer of trolleys 15 and 16 from the track 8 to the track 6 or alternatively to the track 25. In particular, the switch 28 includes a pivoted diverter arm 30 connected to an actuator 31 which is in turn connected to a centralized controller which is represented by box 32. The controller 32 may include a computer or the like. Sensor means such as electric eyes 35 and 36 are positioned along the tracks 6 and 25 respectively, to identify passage of trolleys 15 and 16 therealong. The electric eyes 35 and 36 are linked to the controller 32 such that the controller 32 can identify passage of trolleys 15 and 16 onto tracks 6 or 25 and thereafter operate the switch 28 to divert succeeding such trolleys along an appropriate track.

The track 25 is also a power and free track such that trolleys 15 and 16 are driven therealong by a driving chain. The track 25 intersects with the power track 5 at a juncture 40. The juncture 40 includes a switch of the same type as switch 28 shown in FIG. 4 which is also linked to the controller 32. Suitable sensing means is also provided, such as electric eyes which are also linked to the controller 32 to allow the controller 32 to identify passage of trolleys 15 and 16 onto a continuation track 41 or alternatively along the power track 5.

The track 41 is essentially colinear with the track 25 whereat the two intersect and includes means for driving the trolleys therealong such as a power chain which is seen in the present embodiment as chain 44.

The continuation track 41 intersects with the free track 7 at a third juncture 45 similar to juncture 24 with an appropriate control switch linked to the controller 32. The continuation track 41 also intersects with a cross-over track 46 at the juncture 45. The cross-over track 46 in turn intersects with the power track 5 at a fourth juncture 48. In the present embodiment, the power chain 44 feeds along the track 8 so as to drive carriers 15 and 16 therealong, then along track 25, then along track 41, then along track 46 to near whereat track 46 intersects with track 5 at which point the chain 44 diverges from track 46 and loops around to the start of power track 5 near the juncture 40.

The free track 6 and the power track 5 converge at juncture 55 and continue as a power track to a second juncture 56 whereat the power track 5 converges with the free track 7 and continues as the power and free transfer or discharge track 9 which is also powered by the driving chain 19.

In use the conveyor system 1 has a plurality of carriers 10, each mounted on a lead trolley 15 and a trailing trolley 16 that are carried along the power and free feed track 8 by the drive chain 44. As the carriers 10 approach the juncture 24, the controller 32 activates the switch 28 to transfer or direct every second trailing trolley 16 onto the free track 6 and all of the lead trolleys 15 and the other trailing trolleys 16 along the power and free diverging track 25.

At the switch juncture 40 a switch is activated to convey the lead trolleys 15, associated with the trailing trolleys 16 that were conveyed to the free track 6, onto the central power track 5. Both the lead trolleys 15 and trailing trolleys 16 of the other carriers 10 are diverted to the power and free continuation track 41 and juncture 45. At the juncture 45 the lead trolleys 15 of the carriers 10 on the track 41 are transferred to the power and free crossover track 46 and subsequently to the power track 5.

The trailing trolleys 16 of the carriers 10 on the track 41 are subsequently transferred to the free track 7. The lead trolleys 15 of each carrier 10 are then driven along the track 5 until a cam 60 of a forward one of the trolleys 15 engages a lever arm 61 of a subsequent lead trolley 15 which biases the lever arm 61 such that the dog 21 associated with the lever arm 61 is biased away from the drive chain 19 and is no longer driven thereby.

In this manner, the carriers 10 become staged, stored, banked or accumulated with each of the lead trolleys 15 located along the power track 5. In addition, the trailing trolleys 16 of the carriers 10 are alternatively located on tracks 6 and 7 respectively, such that the carriers associated with either of the free tracks 6 or 7 align generally parallel and in side-by-side relation to one another.

In this manner, the carriers 10 can be positioned in relatively close proximity to one another and in relatively high density with the lead trolleys 15 being preferably approximately just slightly longer than one-half of the carrier width.

Figure 2:
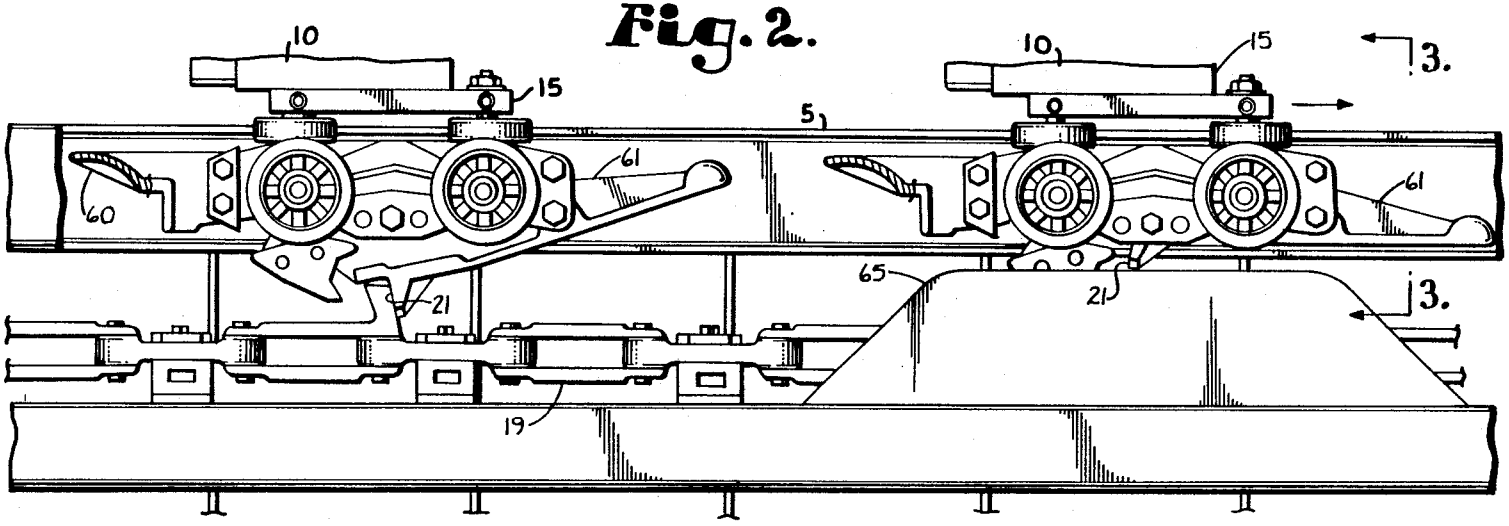
FIG. 2 is an enlarged, fragmentary and side elevational view of the system, showing lead trolleys on a power and free track.

The lead trolley 15 of the first carrier 10 on the power track 5 is also preferably disengaged from the drive chain 19 until it is desirable for such carrier 10 to pass on to the discharge track 9. Such disengagement is occasioned by a cam 65, as illustrated in FIG. 2. The cam engages the dog 21 to urge the dog 21 out of engagement with the drive chain 19, as is illustrated by the trolley 15 on the right in FIG. 2. When it is desirable to feed a carrier 10 onto the discharge track 9, the lead carrier 10 may be pushed past the cam 65 by manual operation or by an automated pusher of conventional type.

Illustrated in FIGS. 5, 6, 7, and 8 is a first modified embodiment of a conveyor system in accordance with the present invention which is generally represented by the reference numeral 100. The conveyor system 100 is similar to the conveyor system 1 in that a plurality of carriers 105 are generally aligned parallel on an alternating basis on opposite sides of a power track 106.

The conveyor system 100 includes the central power track 106 and a pair of free tracks 107 and 108. The track 107 diverges from an original power and free type supply track 110 at a controlled juncture 111 having a diverter switch similar to the diverter switch 28 of the previous embodiment. The power track 110 continues as track 112 and converges with power track 106 at a second juncture 115 also having a suitable switch such as switch 28 of the previous embodiment.

Also diverging from the juncture 115 is the free track 108. Tracks 106 and 107 converge at juncture 120 and continue as a powered track to juncture 121 whereat they converge with track 108 and continue as a powered track 122. The carriers 105 are accumulated along the power track 106 in the same manner as the previous embodiment. The difference between the present embodiment and the previous embodiment is in the manner of handling of the carriers 105 that are associated with the track 108. In particular, the carriers 105 include a lead trolley 125 and a trailing trolley 126. For the carriers 105 associated with the free track 107, the method of accumulation is quite similar to the previous embodiment. However, the manner in which the trailing trolleys 126 associated with the carriers 105 associated with the free track 108 is somewhat different than that described in the previous embodiment.

Figure 8:
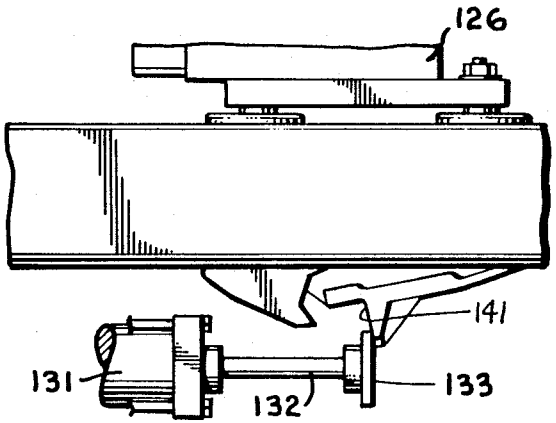
FIG. 8 is an enlarged, fragmentary and cross-sectional view of the first modified conveyor system, taken along line 8–8 of FIG. 6.
Figure 6:
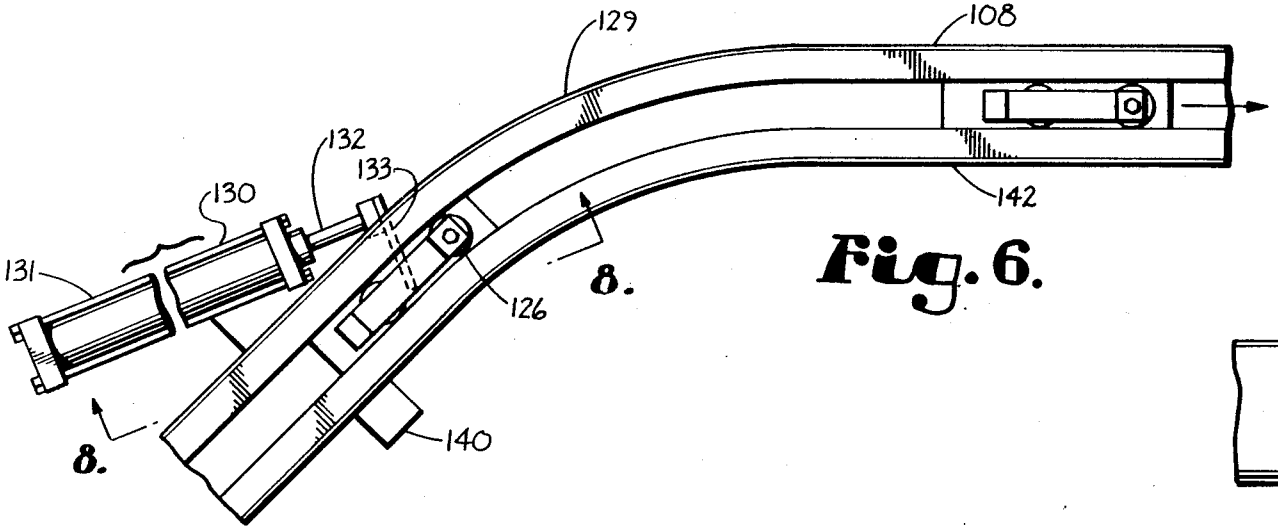
FIG. 6 is an enlarged, fragmentary top plan view of the first modified system showing detail of a pusher.
Figure 7:
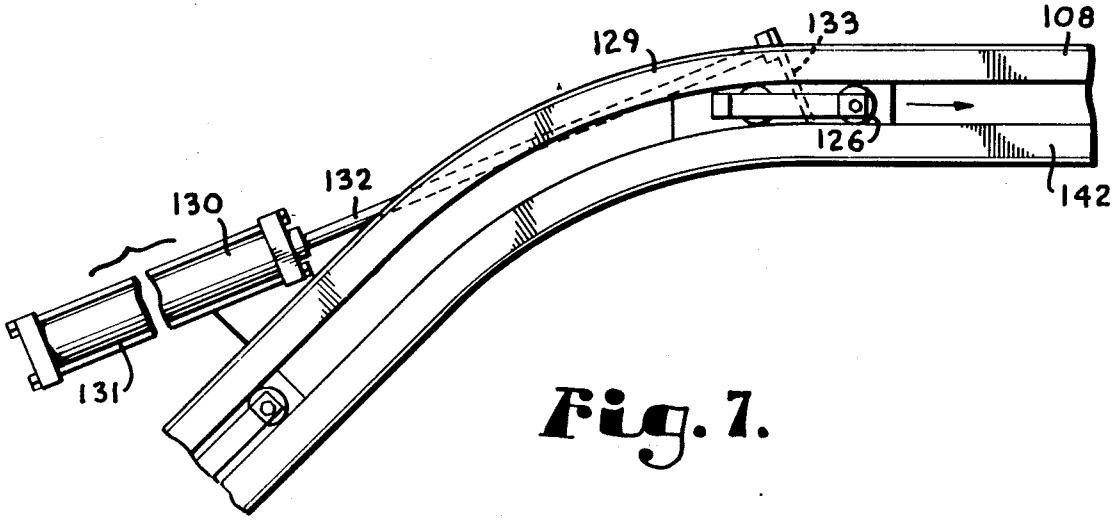
FIG. 7 is an enlarged, fragmentary and top plan view of the first modified system, similar to FIG. 6 and showing the pusher in an extended position thereof.

In particular, as every other carrier 105 (in particular, those carriers 105 associated with track 108) are conveyed along the track 115, the lead trolleys 125 thereof are transferred to the power track 106 at the juncture 115 and the trailing trolleys 126 are conveyed onto the free track 108. As the curvature associated with the track 108 whereat the track bends to become parallel with the track 106 is not a circular arc, the carriers 105 would become bound if solely pulled along the track 108 by the lead trolley 125. Consequently, a pusher 130 is positioned adjacent to the track 108 near the curve 129, as is illustrated in FIGS. 6, 7 and 8.

Figure 5:
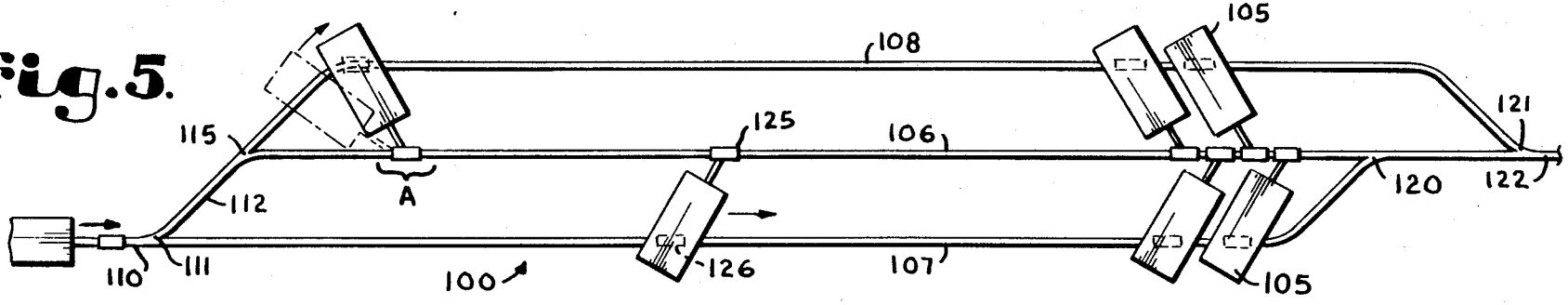
FIG. 5 is a top plan view of a first modified conveyor system in accordance with the present invention.

The pusher 130 includes a hydraulic ram 131 with a piston 132 having a pusher bar 133 attached thereto. The pusher bar 133 is positioned so as to be triggered when the trolley 126 is properly located so as to be sensed by an electric eye 140. The operation of the pusher 130 is thereby controlled by the electric eye 140 such as the controller 32 described for the previous embodiment. The pusher bar 133 operably engages a dog 141 extending from beneath each trolley 126 in the region of the curved section 129 of track 108 so as to urge the trolley 126 around the curved section 129 and onto a straight section 142 of the track 108. In order for the pusher 130 to effectively push the trolley 126 about the curved section 129 without encountering opposition from the drive chain associated with the track 106, a region designated by the bracket A, as illustrated in FIG. 5, is provided along the track 106 having zero bite. That is, the power chain associated with the track 106 in the region A is spaced from each drive dog 141 associated with the lead trolleys 125 (or alternatively the lead trolleys 125 pass a cam such as the cam 65 shown in the previous embodiment or the like) such that the drive chain does not drive the lead trolleys 125 in the region A and such that the trailing trolleys 126 can be urged around the curve 129 of the track 108 at which time the lead trolleys 125 reingage the drive chain on the power track 106. It is noted that each lead trolley 125 associated with the carriers 105 diverted to the track 107 will also enter the region A, however, these carriers 105 will effectively be driven across the region by the next subsequent carrier 105.

As noted before, the carriers 105 accumulate in side-by-side and parallel fashion on an alternating basis between the tracks 107 and 108 with the lead trolleys 125 of each carrier 105 positioned along the power conveyor 106. Carriers 105 are fed from the region of accumulation along the track 106 to the track 122, as described for the previous embodiment.

Figure 9:
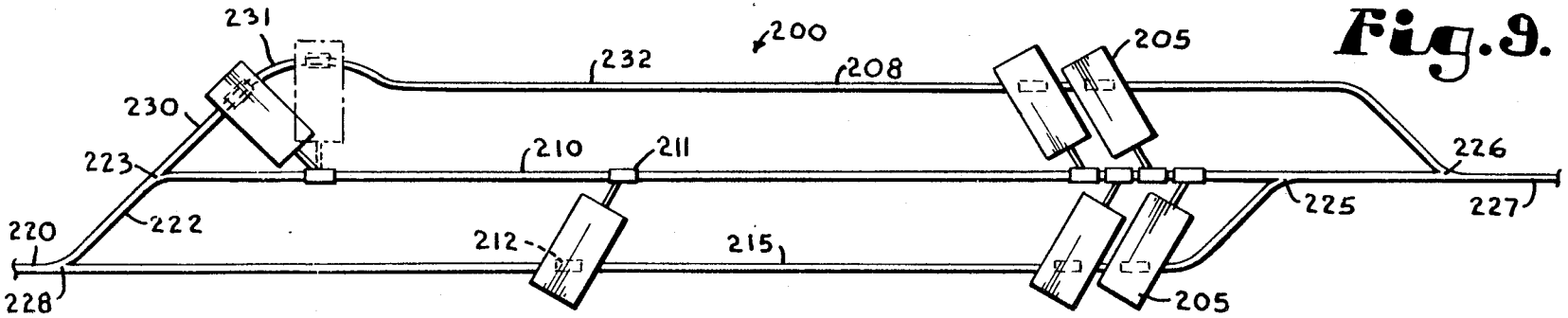
FIG. 9 is a top plan view of a second modified conveyor system in accordance with the present invention.

Illustrated in FIG. 9 is a second modified embodiment of a conveyor system in accordance with the present invention generally designated by the reference numeral 200. The conveyor system 200 is quite similar to the conveyor system 100 described above except as to the manner in which carriers 205 are transferred onto a free track 208. Consequently, except for this difference, the system 200 will be considered similar to the system 100 and will not be described in great detail.

In particular, the conveyor system 200 includes a power and free type central power track 210 receiving forward trolleys 211 of the carriers 205 that are driven therealong by a drive chain such as illustrated in the first embodiment. The conveyor system further comprises a first free track 215 and the second free track 208. The conveyor system 200 is fed carriers 205 by means of a feed track 220 which has a first controlled switch junction 228 branching onto the free track 215 and a diverter track 222. The diverter track 222 branches at a switch juncture 223 into the power track 210 and the free track 208. The free track 215 joins with the power track 210 at the juncture 225 and the free track 232 joins with the power track 210 at the juncture 226 and continues as a discharge track 227 that transfers the carriers 205 away from the conveyor system 200. The feed track 220, the diverter track 222, the central power track 210 and the discharge track 227 are all power and free conveyor tracks including a common drive chain. The free tracks 208 and 215 do not include driving chains.

The major difference between the present embodiment and that of the previous embodiment is in the configuration of the free track 208. In particular, the free track 208 includes a first section 230 which diverges away from the power track 210, a second arcuate curved section 231 and a third generally linear section 232 generally aligned parallel to the power section 210. The curved section 231 has a generally circular curvature having a radius approximating the length between the axes of rotation of the trolleys 211 and 212. The purpose of the curved section 231 is to prevent the carriers 205 from binding as the trailing trolleys 212 thereof navigate the curved section 231. A pusher of the same type described as pusher 130 for the previous embodiment is utilized to push the trailing trolleys 212 past the outermost point (relative to the power section 210) of the curved section 231.

In use, the conveyor system 200 functions quite similar to the conveyor systems of the previous embodiments in that the carriers 205 are accumulated in side-by-side relationship to one another and with little or no extraneous spacing therebetween with the lead trolleys 211 on the power and free central power track 210 and with the trailing trolleys 212 alternatively positioned on the first free track 215 and the second free track 208 so as to provide for accumulation of the carriers 205 in a twin bias banking configuration.

Figure 10:
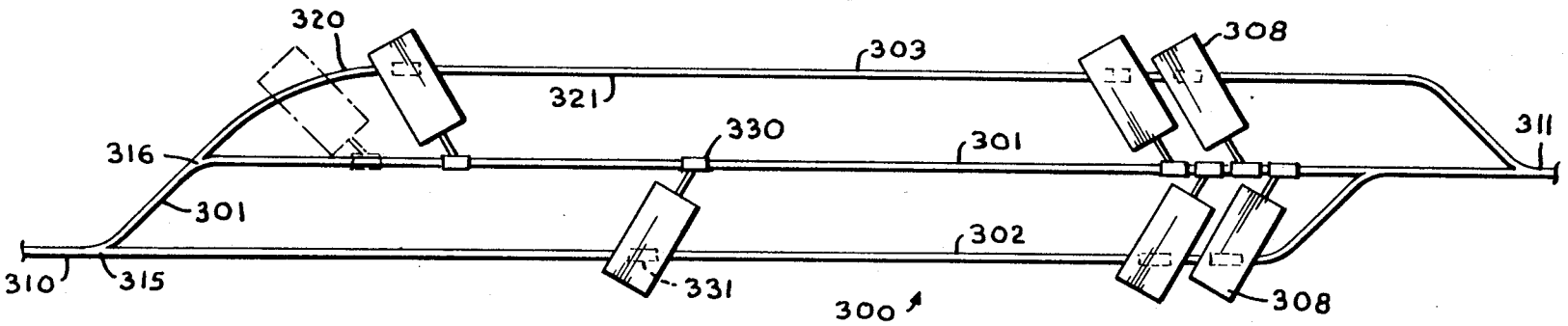
FIG. 10 is a top plan view of a third modified conveyor system in accordance with the present invention.

Illustrated in FIG. 10 is a third modified embodiment of the conveyor system in accordance with the present invention generally designated by the reference numeral 300. The conveyor system 300 includes a central power track 301, a first bias free track 302 and a second bias free track 303. This system is fed a plurality of carriers 308 from a feed track 310 and the carriers 308 are conveyed away from the system 300 by a transfer track 311.

The feed track 310 branches into the first free track 302 at a switch control junction 315 and into the power track 301. Branching from the power track 301 at a second switch controlled juncture 316 is the second free track 303. As with the previous embodiments, the free tracks 302 and 303 join with the power track 301 to discharge carriers 308 onto the transfer track 311. The feed track 310, the power track 301 and the transfer track 311 are of the power and free conveyor type tracks having a drive chain such as the chain 19 illustrated in the first embodiment.

The conveyor system 300 is quite similar to the conveyor system 200 except that the free track 303 includes a curved section 320 whereat the track 303 diverges from the track 301 that generally joins with a linear section 321 that is parallel to the power track 301. The curved section 320 is generally arcuate from the juncture 316 to the linear section 321 having a radius greater than the radius between the axes of rotation of the lead trolley 330 and the trailing trolley 331 associated with each of the carriers 308. In this manner, the trailing trolleys 331 that are conveyed onto the free track 303 are allowed to slide around the curved section 320 by being pulled by the lead trolleys 330 that are driven by the chain associated with the power section 301 without binding and without need for a pusher to assist same.

In use, the conveyor 300 is quite similar to that of the previous embodiments in accumulating a plurality of carriers 308 in a twin bias accumulated configuration in such a manner that the carriers 308 can then be subsequently transferred to another station downstream by the transfer track 311 and the carriers 308 are transferred downstream in the same order in which such carriers 308 arrive at the conveyor system 300.

Figure 11:
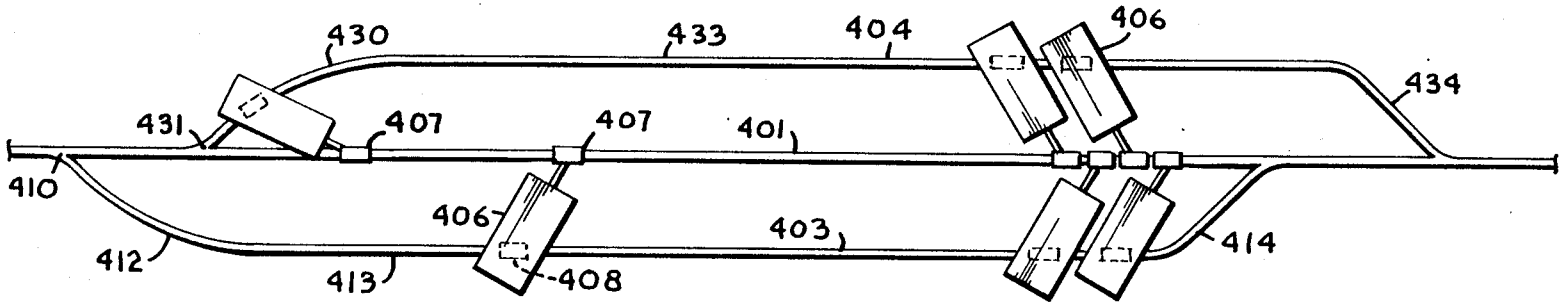
FIG. 11 is a top plan view of a fourth modified conveyor system in accordance with the present invention.

Illustrated in FIG. 11 is a fourth modified conveyor system in accordance with the present invention generally designated by the reference numeral 400. The conveyor system 400 is similar in many ways to the previous conveyor systems and corresponding parts will not be discussed in great detail.

In particular, the conveyor system 400 includes a central power and free track 401 and free tracks 403 and 404. A plurality of carriers 406 are conveyed along the power track 401 and each includes a lead trolley 407 and a trailing trolley 408.

The first side or free track 403 diverges from the power track 401 at switch juncture 410 similar to juncture 24 of the first embodiment. The free track 403 includes an arcuate diverging section 412 diverging from the juncture 410 and connecting to a linear section 413 generally parallel to the power track 401 and finally ending in a converging section 414 which reconverges with the power track 401. The curved section 412 has a generally smooth arcuate curve extending generally from the juncture 410 to the linear section 413 with a radius that is sufficiently large to ensure that the carriers 406 with a lead trolley 407 on the track 401 and a trailing trolley 408 on the track 403 does not bind in the region of the curved section 412 as the lead trolley 407 is being drawn along the power track 401 by a drive chain similar to the drive chain 19 of the first embodiment.

Likewise, the second free track 404 has a curved section 430 which joins with the power track 401 at a switch juncture 431 at a spaced location from the juncture 410 and further joins with a linear section 433 that is positioned parallel to the power track 401. The linear section 433 joins with a converging section 434 which rejoins the power track 401.

In use, the power and free system 400 provides for the accumulation of carriers 406 in side-by-side relationship on opposite sides of the power track 401 such that the leading trolleys 407 of the carriers are aligned along the power track 401 and the trailing trolleys 408 of the carriers 406 are alternatively positioned on the free tracks 403 and 404. The carriers 406 are originally diverted to the respective positions thereof as described above by operation of the switch junctures 410 and 431.

In particular, the juncture 410 is operated so that the lead trolleys 407 of the carriers 406 are directed along the power track 401 and that alternating trailing trolleys 408 are conveyed onto the free track 403. The remaining free trolleys 408 on the track 401 subsequent to the juncture 410 are transferred at the juncture 431 to the free track 404, while the lead trolleys 407 continue along the power track 401. The lead trolleys 407 are drawn by the chain drive of the power track 401 to the staging location near the right hand side of the power track 401 as seen in FIG. 11 and the trailing trolleys 408 are pulled along the free tracks 403 and 404 such that the carriers 406 assume a side-by-side and alternating position as seen on the right in FIG. 11.

It is to be understood that while certain forms of the present invention have been illustrated and described herein, it is not to be limited to the specific forms or arrangement of parts described and shown.

What is claimed and desired to be secured by Letters Patent is as follows:

1. In a conveyor system having a power and free power track with a first free track having a section aligned generally parallel to said power track for bias accumulation of carriers having lead and trailing trolleys along said power track wherein the lead trolleys of said carriers are located along said power track; the improvement comprising:

(a) a second free track located so as to have a section generally parallel to the power track opposite said first free track; and including (b) switching means for switching the lead trolley of each of said carriers onto the power track while alternatively switching the trailing trolleys of said carriers to said first and second free tracks such that said carriers are twin biased banked along said power track with carriers being positioned alternatively on opposite sides of said power track.

2. The conveyor system according to claim 1 including:

(a) a common feed track diverging into said power track, said first free track and said second free track, and wherein said switching means automatically switches said lead trolleys from said feed track to said power track and said trailing trolleys from said feed track alternatively to said first and second free tracks.

3. The system according to claim 2 wherein:

(a) said feed track is generally colinear with said first free track; and said system including:

(b) a power and free cross-over track extending between a start of said second free track and said power track such that carriers with trailing trolleys directed to said second free track are first diverted to said cross-over track such that the trailing trolley of such a carrier is positioned in alignment with said second free track and the lead trolley of such a carrier is conveyed across said cross-over track to said power track; and including (c) a switching mechanism to divert alternative trailing trolleys to said second free track.

4. The system according to claim 2 wherein said system includes:

(a) pusher means to convey selected trailing trolleys onto said second free track so as to prevent binding.

5. The system according to claim 4 wherein:

(a) said power track includes a region of zero bite wherein trolleys thereon are not driven; said second free track including an internal curved section and a subsequent linear section generally parallel to said power track; and said zero bite region is located to receive the lead trolley of a carrier during the period when a trailing trolley of such carrier is on part of said second free track curved section to prevent binding of such carrier.

6. The system according to claim 4 wherein:

(a) said second free track includes an initial curved section; and (b) said curved section has a radius approximately equal to the distance between axes of the lead and trailing trolleys located on one of said carriers.

7. The system according to claim 2 wherein:

(a) both said first and second free tracks have an initial curved section having a radius greater than the distance between the lead and trailing trolleys on each of said carriers such that trailing trolleys can be diverted alternatively to said first and second free tracks without binding.

* * * * *